US006505979B2

(12) United States Patent
Twist et al.

(10) Patent No.: US 6,505,979 B2
(45) Date of Patent: Jan. 14, 2003

(54) PROCESSING PHOTOGRAPHIC MATERIAL

(75) Inventors: Peter J. Twist, Buckinghamshire (GB); Anthony Earle, Harrow Weald (GB); Nigel R. Wildman, Watford Hertfordhire (GB); Leslie R. Wells, Bounds Green London (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/920,495

(22) Filed: Aug. 1, 2001

(65) Prior Publication Data

US 2002/0061195 A1 May 23, 2002

(30) Foreign Application Priority Data

Sep. 20, 2000 (GB) ..... 0023091

(51) Int. Cl.[7] ..... G03D 3/04
(52) U.S. Cl. ..... 396/625; 396/634
(58) Field of Search ..... 396/576, 633–636, 396/598, 625; 355/27–29; 134/121, 122 R, 122 P, 64 P, 77, 117–120

(56) References Cited

U.S. PATENT DOCUMENTS

| | | | | | |
|---|---|---|---|---|---|
| 1,347,032 | A | * | 7/1920 | Hammond | 242/536 |
| 2,719,473 | A | | 10/1955 | Buttigieg | 396/634 |
| 3,641,910 | A | | 2/1972 | Smith | 396/623 |
| 3,668,997 | A | * | 6/1972 | Ratowsky | 134/120 |
| 4,269,501 | A | | 5/1981 | Griffith et al. | 396/625 |
| 4,302,092 | A | * | 11/1981 | Ashton et al. | 134/121 |
| 4,350,430 | A | * | 9/1982 | Johnson | 366/208 |
| 4,444,480 | A | * | 4/1984 | Freeman | 396/603 |
| 4,473,283 | A | | 9/1984 | Bernhardt et al. | 396/634 |
| 4,613,223 | A | * | 9/1986 | Cherry et al. | 396/603 |
| 4,634,251 | A | | 1/1987 | Jonker | 396/598 |
| 5,438,384 | A | * | 8/1995 | Earle | 396/634 |
| 5,867,747 | A | * | 2/1999 | Lynch et al. | 396/571 |

FOREIGN PATENT DOCUMENTS

| | | |
|---|---|---|
| DE | 590537 | 12/1933 |
| FR | 633835 | 2/1928 |
| NL | 288055 | 3/1965 |
| NL | 113444 | 12/1966 |

* cited by examiner

*Primary Examiner*—D Rutledge
(74) *Attorney, Agent, or Firm*—Frank Pincelli

(57) ABSTRACT

A method of processing a photographic material in which the material is loaded into a rotatable chamber and a metered amount of solution is introduced into the chamber. The chamber is rotated and the solution is continuously swept along the surface of the material, forming a wave through which the material passes to enable uniform processing.

88 Claims, 11 Drawing Sheets

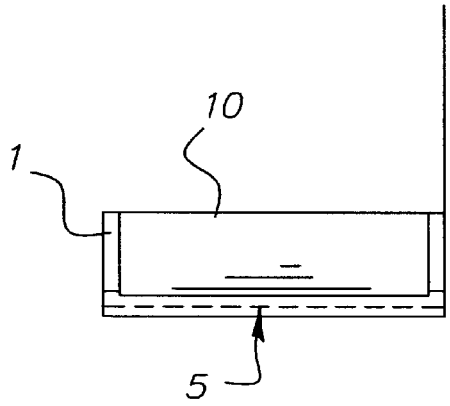
FIG. 4A
FIG. 4B
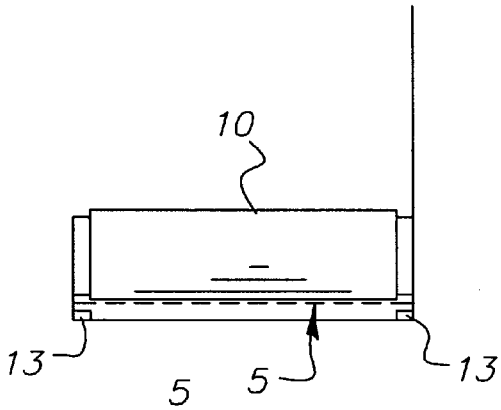
FIG. 4C
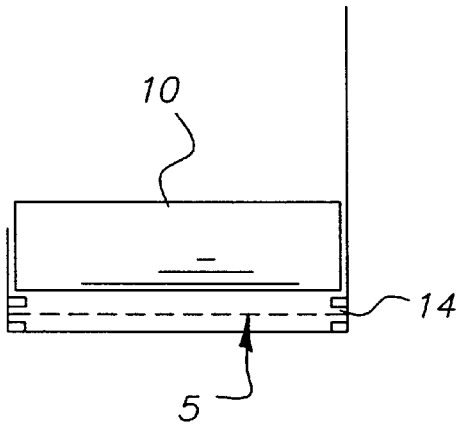

PROCESSING PHOTOGRAPHIC MATERIAL

FIELD OF THE INVENTION

This invention relates to a method and apparatus for processing photographic material. In particular, the invention relates to a method of processing which uses a low volume of processing solution.

BACKGROUND OF THE INVENTION

Conventional processing of photographic material requires the use of large tanks of processing solutions. Each tank contains a processing solution such as developer, bleach, fixing solution or washing solution. The material is transported through each tank in turn. There is a tendency for the solutions to carry over from one tank to another leading to pollution of the solutions. Conventional processing has several other drawbacks. The temperatures which can be utilized are limited and therefore the process is slow. The composition of the solutions must be stable over long time periods in the processing tanks. Replenishment of the solutions is difficult to control. The processing apparatus is also very large due to the number of processing tanks.

To overcome the problems of conventional deep tank processing surface application of the processing chemicals was developed. In previous surface application methods a volume of solution is applied to the surface of the material being processed. However, previous surface application methods have several drawbacks. If the solution applied to the material is just left on the material in a static condition the processing will be very slow and inefficient because there is no agitation and by-products accumulate in the material layers and slow down processing. This method is also prone to non-uniformity of processing.

It is also known to process the material within a rotary tube. The material to be processed is placed emulsion side facing inwards within the tube. Solution is added and the tube rotated. Large volumes of processing solution (70 ml./sq. ft and upwards) will process the material effectively so long as rotation is not so fast as to cause dispersion of the solution puddle. Rapid rotation of the device is however very desirable to quickly and evenly distribute a given small volume of solution over the whole surface of the material so that processing is uniform from one end to the other. If the rotation is too slow there will be seasoning of the small volume of solution by the front end of the material and processing will be different at the back end of the material. Small volumes of processing solution (50 ml./sq. ft or less) do not properly process film or paper because when the device is rotated, even at low speeds of rotation, the solution puddle is dispersed and spread over the whole surface of the material. Consequently there is no agitation. This leads to several processing defects. Processing is streaky, non-uniform and also slow because of local consumption and the accumulation of by-products. There is no surface mixing and chemical economy is therefore low.

The invention aims to provide a method and apparatus in which the above mentioned problems are overcome. The defects can be overcome by using a rotating device in such a way as to provide a means of sweeping the surface of the material to be processed clean of solution at each revolution.

SUMMARY OF THE INVENTION

It is an aim of the invention to provide a processor and a method of processing in which only very small volumes of solution are necessary similar to the volumes used to replenish large tank processors but which gives satisfactory results in terms of sensitometry and uniformity.

The invention provides a method in which a single small volume of processing solution for a given process stage is added to a length of material to be processed and which spreads and mixes the whole volume of the solution continuously while processing is occurring.

A given small volume of processing solution is spread repeatedly over the entire length of the material to be processed. The volume used must be in excess of that which is absorbed by the material. The excess volume required need only be small. The method allows surface application of processing solution but also enables mixing and redistribution of seasoning products.

According to the present invention there is provided a method of processing a photographic material, comprising the steps of loading the material into a chamber adapted to hold the material therein, introducing a metered amount of solution into the chamber, rotating the chamber and continuously sweeping the surface of the material as the chamber rotates to thereby form a wave in the solution through which the material passes, the whole volume of solution for a given stage being spread over the whole material area in a repetitive manner to enable uniform processing.

The present invention further provides an apparatus for processing a photographic material, comprising a chamber adapted to hold the material therein, means for introducing a metered amount of solution into the chamber, means for removing the solution from the chamber, means for rotating the chamber and means for sweeping the surface of the material at each rotation of the chamber, thereby to form a wave in the solution through which the material may pass.

The invention further provides a method of processing photographic material comprising the steps of loading the material onto a carrier with the photosensitive side facing outwards, the carrier resting on drivable rollers such that the clearance between the surface of the material and the rollers is minimal, the rollers being located within a container of processing solution, driving the rollers, the rotation of the rollers causing the carrier to rotate and thus the material to pass through the processing solution, thereby providing agitation and mixing of the solution on the surface of the material to enable uniform processing.

The invention yet further provides an apparatus for processing photographic material, comprising a container for holding processing solution, a number of drivable rollers located within the container, and a carrier for carrying the photographic material with the photosensitive side facing outwards, the carrier resting on the rollers, the drivable rollers and the carrier being spaced such that when the carrier is loaded with the material the gap between the surface of the material and the roller is minimal.

The method and processor of the invention allow uniform and rapid processing to be carried out with only very small amounts of processing solution, in the order of 0.5 to 6 ml./linear foot(1.6 to 19.8 ml/linear meter) of 35 mm film and these volumes can be compared with the replenishment rate for a typical 400 speed color negative film in the industry standard Flexicolor C-41 process of about 6 ml/linear foot. The ability to use very low volumes does not preclude the use of larger volumes in the method and apparatus of the invention although it is not necessary to do so. Only a single processing space is required. The appropriate solution for each processing stage is added and removed sequentially from the processing space. Therefore the processing apparatus may be smaller than those of the prior art.

It is also possible to carry out rapid processing in the processor because the volume used is equal to the replenishment volume used in a conventional deep tank processor and is disposed of after the process. Thus solutions which are stable for only a short time can be used for the development, stop, bleach, bleach-fix, fix and wash stages and any other stage. In addition the temperature in the processor can be much higher than in a conventional large tank processor, up to approximately 80° C., because the solutions are used within a few minutes and then disposed of This avoids any problems of evaporation and crystallization that can occur with large tank processors at high temperatures. Thus high temperature allows more rapid processing. The usage rate of the solutions is no higher than in large tank processors and in many instances can be less. This is particularly true since in the method of the invention processing solutions can be run close to exhaustion which is not possible in a conventional processor. Thus the method of the invention can provide much lower chemical usage rates than a conventional method. Process cycles can be changed very quickly just by changing the timing of each stage. This allows the process to be "instantly customized" for a particular film which results in better film performance. For example, the processor recognizes any manufacturer's film and will adjust the cycle time to the optimum value for that film. This ability cannot be accomplished in a conventional method or apparatus. Different amounts of any solution used in any stage can be added merely by means of software control of the solution delivery system. Temperature can be changed quickly because of the small size of the equipment. The invention can accommodate any process for color film, color paper, reversal film, reversal paper, black and white film or paper.

The method of the invention can also be used for Redox amplification (RX) processing since small volumes of potentially unstable solutions can be used. Thus developer amplifiers, amplifiers or intensifiers and silver bleaches containing hydrogen peroxide or compounds which liberate hydrogen peroxide which can be unstable and not practical to use in conventional methods and apparatuses, can be used simply, easily and reproducibly within the method and apparatus of the invention.

The method of the invention uses component solutions which are kept before their use in containers substantially free of air access and which are stable over long periods of time. Since the solutions used to process film are fresh every time a film is processed, processing consistency is superior to that in a conventional large tank processor. In a conventional large tank processor, variations in processing can occur because it has been idle for some time or because of a low throughput of film. These variations are eliminated by the method and apparatus of the invention.

Since the developer solution is made from two compositions which are stable until mixed and the solution is used within thirty seconds of mixing the developer solution does not need to include anti-oxidants. This eliminates the cost of the anti-oxidants.

Continuous processing machines are replenished in order to make up for chemistry used in processing films. To maintain the chemical levels accurately the replenishment rate must also be accurate. The replenishment rate depends on the film type, that is whether the film is 100, 200, 400 or 800 speed, and also on the utilization of the processor. Since the film type will vary and the utilization will vary the ideal replenishment rate will vary. The replenishment rate is not easy to change to accommodate these factors and in order to monitor the state of the process a special type of film called a control strip is put through the process. A control strip is pre-exposed by the manufacturer under strictly controlled conditions and the correct response from this control strip is measured by the manufacturer in a process that is "on aim" and supplied with the control strips the process operator will use. The process operator or customer will run a control strip through the process, measure the control strip on a densitometer and compare the result with a correctly processed check control strip supplied by the manufacturer with the pre-exposed control strips. The result of this test will tell the process operator if the replenishment rate is correct or if it needs to be increased or decreased to bring the process "on aim". The use of control strips is both costly and time consuming and it is desirable to be able to eliminate the need for their use. This can be achieved by the method of the invention since the processing chemistry is made from stable concentrates just before use and then disposed of immediately after use. The stable concentrates are supplied by the manufacturer and are of the correct composition thus the processing chemistry is "always fresh" and does not age, season or deteriorate as in conventional processors. Thus control strips are not needed. This eliminates the cost of control strips and also the labor and downtime needed to process the control strips.

In conventional large tank processors low utilization of the processor is a major problem because the standing solutions are in essentially open tanks which allow them to evaporate, oxidize and age and become unsuitable to process film. This can only be overcome by increasing the replenishment rate or by emptying the tanks and refilling with fresh solutions. These measures are costly and time consuming. These problems are eliminated by the method and apparatus of the invention. In the method of the invention the processor can stand unused for any length of time up to the lifetime of the component solutions and then be used to produce correctly processed film.

The method and apparatus of the invention allows the processor to be small and therefore cheaper to manufacture compared with conventional large tank processors. In addition a very small area or "footprint" is occupied at the processing site and thus installation is cheaper.

The method and apparatus of the invention allows an equivalent process to that run in a conventional large tank processor to have higher productivity. This is because the time required to process the entire film is equal to the total cycle time (the sum of the individual solutions times) and the film can be removed from the processor in about 4 seconds. In a conventional processor the leading end of the film exits the processor in the total cycle time but the film cannot be removed from the processor until the trailing end exits, which is several minutes later. Thus the process time equals the total cycle time plus the transport time. These restrictions are avoided by the invention.

BRIEF DESCRIPTION OF THE DRAWINGS

The invention will now be described, by way of example, with reference to the accompanying drawings, in which:

FIGS. 4A, 4B and 4C show different film and roller configurations;

DETAILED DESCRIPTION OF THE INVENTION

Figure 1B:
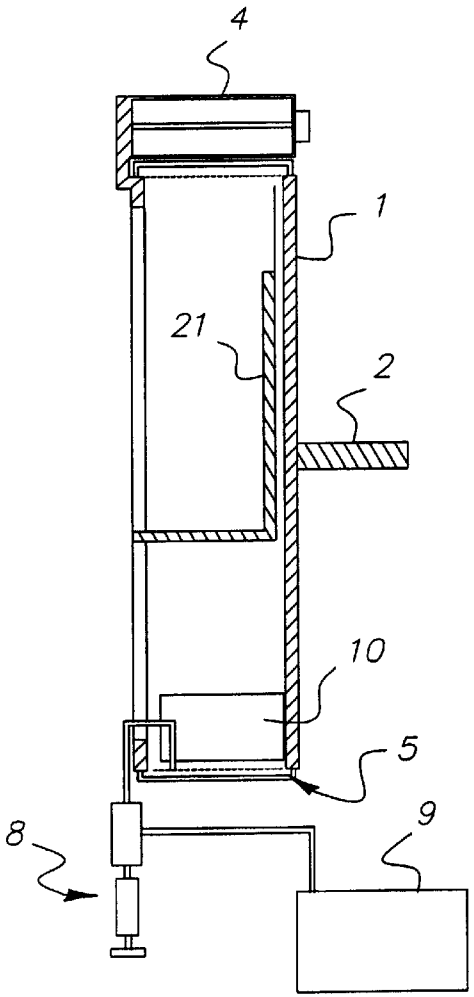
FIGS. 1A and 1B show a schematic side view and section view respectively, of a first embodiment of the present invention.
Figure 1A:
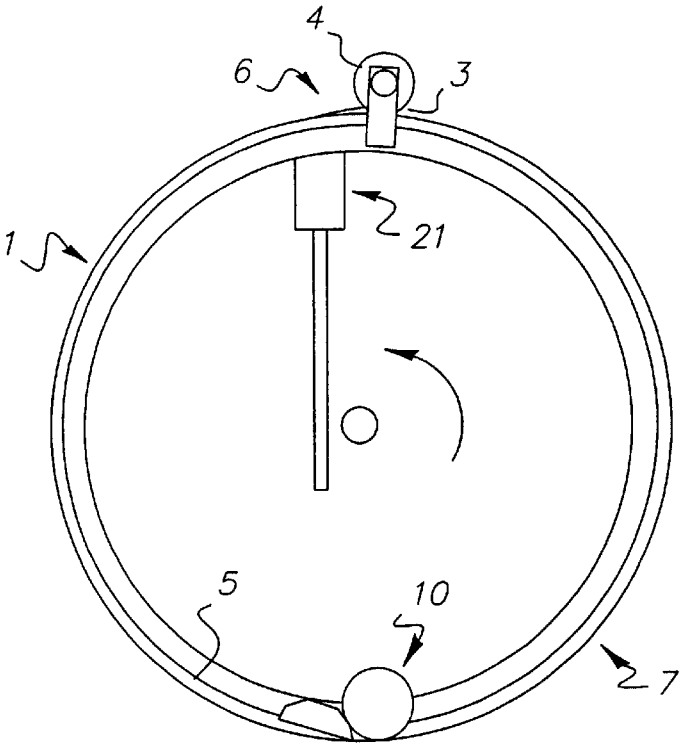

FIG. 1A and 1B show a fist embodiment of the invention.

The wave processor comprises a cylinder 1 having at least one open end. The cylinder may be made of stainless steel, plastics or any other suitable material. A transparent material, such as polycarbonate, may be used if it is desired to scan the material while it is within the cylinder. The cylinder defines a processing chamber. An arm 3 is provided on the outer side of the cylinder for holding a film cassette 4. A slot 6 with a water tight cover (not shown) is provided through the wall of the cylinder to allow the strip of film 5 from the film cassette to enter the processing chamber. The watertight cover may be in the form of a hinged door having a rubber wedge. However, any suitable means may be used. A circular slot is defined around the inner circumference of the chamber for holding the strip of film 5 by the edges.

A second arm 21 is located within the chamber. This arm 21 grabs the tongue of the film and holds it against the inner circumference of the chamber.

A close fitting cover (not shown) may be provided around the inner circumference of the chamber which sits above the film surface by at least 0.5 mm. This cover provides at least three functions to improve the performance of the apparatus. Firstly it lowers water evaporation which can cause a temperature drop and can concentrate the processing solution as processing is occurring. Secondly it can itself provide agitation by maintaining a puddle of solution in the gap between the cover and the film surface at the lowest point of the chamber. Thirdly it provides a film retaining means making edge guides unnecessary, although edge guides can be also be provided to prevent the film sticking to the cover. It allows both 35 mm film and APS film (24 mm) to be loaded in the same apparatus and it also allows any length of film to be loaded. The material of the cover can be impervious to processing solution and as such is provided with a break or gap in its circumference so that the two extreme ends of the cover do not meet and through which processing solution is added to the film surface. In this embodiment the cover is fixed and rotates with the chamber as the chamber rotates. In another embodiment the cover is not fixed and rests on rails on each side which allow the cover to slide and remain stationary as the chamber rotates. In this embodiment the cover is again provided with a break or gap in its circumference so that processing solutions can be added to the film surface. In this embodiment a roller can also be provided which sits in the gap in the circumference of the cover and which remains essentially at the lowest point of the chamber. The roller provides additional agitation. In another embodiment the cover can be made of a material which is porous to processing solution such as a mesh material or a material punctured with holes. The cover can be made of plastic, metal, or any suitable material. However, the cover is not an essential feature of the invention.

A drive shaft 2 is provided at the closed end of the cylinder for rotation thereof. The open end of the cylinder 1 is provided with a flange 7. The flange retains solution within the chamber. In the embodiment shown in FIG. 1B the processing solutions are introduced into and removed from the chamber by means of syringes 8. However any suitable means may be used, for example metering pumps. The solutions may be introduced from a reservoir 9. Alternatively the solutions may be held in a cartridge prior to use. The cartridge can consist of part or all the processing solutions required to complete the process and is easily placed or "plugged in" the processor without the need to open or pour solutions. The cartridge can consist of an assembly of containers for each of the solutions required for the process. The solutions may be removed by suction or any other means. Residue of solutions therefore do not build up within the processing chamber. This results in the processing chamber being essentially self cleaning. The cross over times from one solution to another are very short.

It is possible to mount an infra red sensor inside of the chamber. The sensor monitors the silver density of the material during development thereof. However this is not an essential feature of the invention.

A wave forming mechanism is provided within the processing chamber. This wave forming mechanism sweeps the film surface and forms a wave of solution, primarily at the lowest point in the chamber. In the embodiment shown in FIG. 1 the mechanism is a free standing roller 10. It is possible that this roller may be held on a loose spindle, (not shown), which would allow the roller to be steered and also to be raised and lowered into position. The position of the roller can be changed with this mechanism so that it is to the left or right of bottom dead center which can be advantageous for the smooth running of the roller. It is also desirable to raise or lower the roller which might facilitate film loading.

In operation a film cassette 4 is located in the arm 3 and held on the outside of the cylinder 1. The end of the film 5 is withdrawn from the cassette and entered into the processing chamber by means of the slot 6. The arm 21 holds the film against the inner circumference of the cylinder and the cylinder 1 is rotated so that the film 5 is unwound from the cassette and loaded into the processing chamber. The film is held in a circular configuration within the processing chamber. This loading is carried out while the processing chamber is dry although it is also possible to load the film if the chamber is wet. The film is held with the emulsion side facing inwards with respect to the chamber. It is also possible to load the film with the emulsion side facing outwards provided a gap is present between the film surface and the inner circumference of the chamber. Once loaded, the film is held by the edges thereof within the circular slot around the circumference of the chamber.

The processing chamber is heated. The chamber can be heated electrically or by hot air. Alternatively the chamber may be heated by passing the lower end thereof through a heated water bath. The chamber is then rotated. When the desired temperature is reached a given volume of a first processing solution is introduced into the chamber. The processing solution may be heated prior to being introduced into the chamber. Alternatively the solution may be unheated or cooled. As the chamber rotates the film is continuously re-wetted with the given volume of solution.

Figure 2:
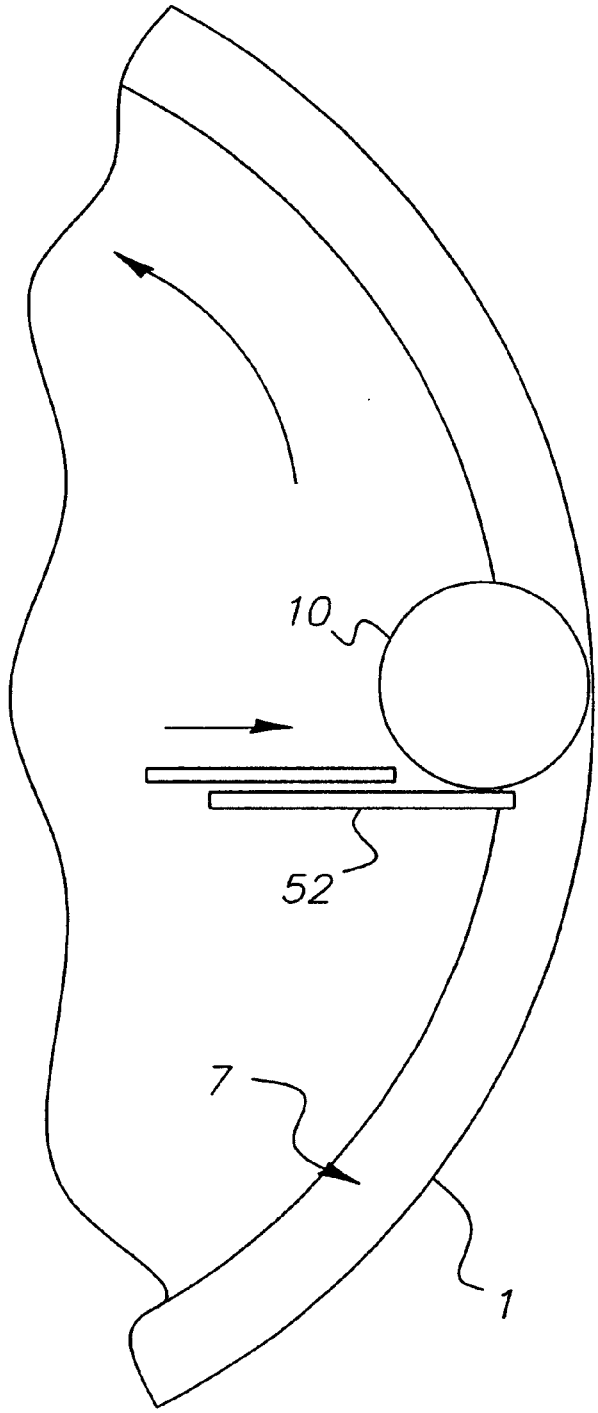
FIG. 2 is an enlarged view of the lower portion of the embodiment shown in FIG. 1.

Processing solution is added onto the roller 10 which is contacted across the whole width thereof by a spreader 52. This can be seen in more detail in FIG. 2. The spreader may be made of flexible soft plastic, rigid plastic or any other suitable material. The roller 10 rotates in contact with the spreader 52. Processing solution is delivered, via a supply pipe, down the spreader to the region of contact between the roller and the spreader. This method forms a uniform bead of solution over the region of contact between the roller and the spreader which extends across the width of the roller 10. This allows uniform spreading of the processing solution onto the film 5 as it passes under the roller 10. It is also possible to add solutions very quickly by "dumping" a given volume into the chamber while it is rotating so that it immediately forms a "puddle" or wave in front of the roller. Yet another method is to add the processing solutions when the chamber is stationary to a region where there is no film or to a region where there is no image such as the fogged end of the film. The rotation of the chamber is then started after the solution has been added. The time interval between adding the solution and starting the rotation can be from zero to any desired hold time.

The roller 10 acts as a wave forming mechanism. This wave forming mechanism, in combination with the rotation of the chamber, provides very high agitation which gives uniform processing even with very active processing solutions. High agitation and mixing are required when only small volumes of solution are being used, in the order of about 0.5 ml. If a large volume of solution is added to the chamber in the absence of a wave forming mechanism a "puddle" of solution is formed and spreading and agitation is achieved. However if a small volume of solution is added to the chamber in the absence of a wave forming mechanism then solution adheres to the film as the chamber rotates. There is no "puddle" formed and there is consequently no agitation or mixing and processing is slow and non-uniform. The agitation and mixing mechanism of the present invention, i.e. the wave forming mechanism, is sufficient to minimize density differences from the front to the back of the film.

Once the first stage of the processing is completed most of the processing solution may be removed by suction. A given volume of the next processing solution is then introduced into the chamber and then removed after the desired time and so on. Finally, the wash solutions are added and removed. The normal mode of operation of the method of the invention is to perform the complete process cycle within the single processing space of the rotating chamber. The process cycle may be develop, stop, bleach, fix and wash. The processing solution for each stage is added to the chamber and left for the required time. It is then removed and the next processing solution is added and left for the required time, and so on until the process cycle is complete. The film 5 may be dried in-situ with hot air. The whole process cycle may thus be carried out within a single processing space.

It is also possible to remove the film at any point in the cycle if desired and the rest of the process can be carried out externally, including drying. It is possible to carry out part of the process within the rotating chamber and part of the process outside the rotating chamber in another type of processing apparatus. The other type of processing apparatus can be a deep tank apparatus in which the film is transported through the tank by means of pairs of drive rollers. The solution or solutions in such a processor can be replenished to maintain constant activity by adding a replenisher solution as is common practice in the art. The other type of processing apparatus can also be a surface application device. Thus it could be advantageous to combine a process stage or stages outside the chamber which can be the developer stage and the stop stage. These stages are followed by loading the film within the chamber and completing the process cycle, that is, bleach, fix and wash stages within the chamber. It could be advantageous to carry out the developer stage, the stop stage, the bleach stage outside the rotating chamber, to load the film into the chamber and to complete the fix and wash stages within the chamber. It could be advantageous to carry out the developer stage, the stop stage, the bleach stage and the fix stage outside the rotating chamber, to load the film into the chamber and to complete the wash stage within the rotating chamber. It could be advantageous to carry out the developer stage and the stop stage within the rotating chamber, to unload the film from the chamber and carry out the rest of the process cycle including the bleach, fix and wash stages, outside the rotating chamber. It could equally be advantageous to carry out the developer stage, the stop stage and the bleach stage within the rotating chamber, to unload the film from the chamber and carry out the fix and wash stages outside the chamber. It could be advantageous to carry out the developer stage, the stop stage, the bleach stage and the fix stage within the rotating chamber, to unload the film from the chamber and to carry out the wash stage outside the chamber. Thus a complete process cycle can be made from combinations of stages within the rotating chamber or outside the rotating chamber.

It can also be advantageous to carry out a truncated process in which one or more of the stages of a complete process cycle is omitted. Thus a truncated process consisting of develop, stop and wash could be carried out. The photographic image would contain undeveloped silver halide and developed silver and would be unsuitable for optical printing. However, the photographic image could be scanned and the digital image subjected to image processing algorithms to correct for the unwanted effects of the retained silver and silver halide. A satisfactory color print could then be digitally produced. The truncated process could be develop, stop and wash, or develop, stop, bleach and wash, or develop, stop, fix and wash.

Figure 3B:
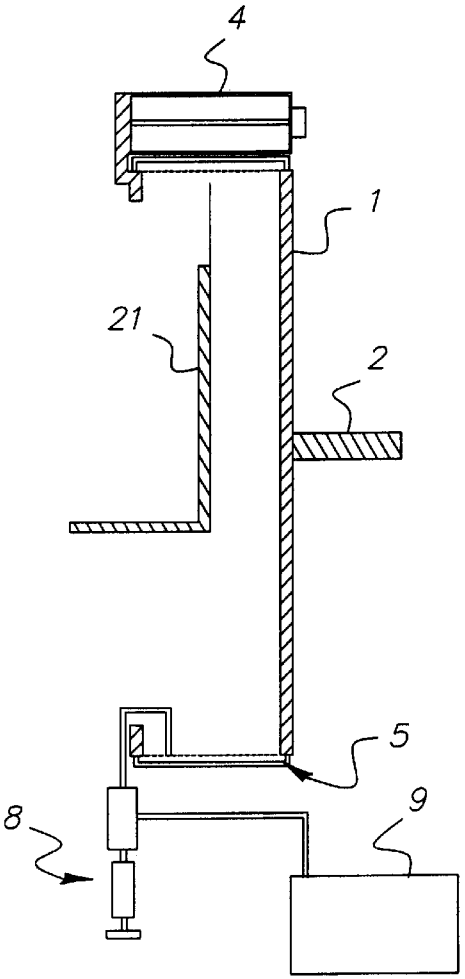
FIGS. 3A and 3B show a schematic side view and section view respectively, of a second embodiment of the invention.
Figure 3A:
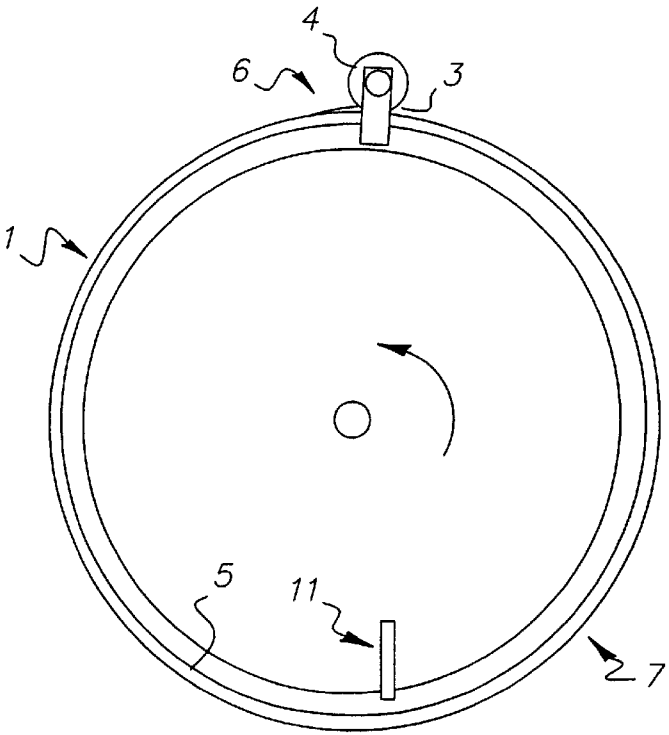

The process cycle is almost instantly changeable and allows rapid processing of both film and paper. Super rapid processing may be achieved with simplified film structures, such as those intended for scan only. FIGS. 3A and 3B show a second embodiment of the invention. The processing chamber is identical to that shown in FIG. 1 with the exception of the wave forming mechanism. In this embodiment the wave forming mechanism is an air knife 11. This knife directs a jet of air of approximately rectangular cross-section of the same width as the film onto the film surface and thus displaces solution to form a "bow-wave". This has the same effect as the roller in maintaining high agitation and mixing.

Various other means may be used to provide the wave needed for correct agitation and mixing of the solution on the surface of the film. For example, another means of forming a wave is to use a collection of small glass or plastic balls of about 3 to 5 mm in diameter. These are placed in the lowest point of the processor and act in the same way as a single roller to form a wave through which the film passes.

Another means of sweeping the surface to form a wave is to use a piece of flexible material such as thin flexible plastic sheet, a plastic mesh or silk-screen material where one end is supported on a spindle and the other end is draped onto the film surface. This forms a meniscus of solution between the sheet and the film surface which provides high agitation and mixing.

Another means of sweeping the surface to form a wave is to use an electrostatically charged rod which is held near the film surface and which displaces solution from the surface of the film in a manner similar to an air-knife.

It is clear that there are multitudinous ways in which a wave might be formed and which would thereby fulfil the principle of the invention.

FIGS. 4A, 4B and 4C show various film and roller configurations within the processing chamber.

FIG. 4A shows the film 5 held by both edges under a slot defined in the circumference of the chamber 1. The emulsion side of the film faces the inside of the chamber. In this embodiment the roller 10 rotates on the emulsion surface as the chamber rotates.

In FIG. 4B the film 5 is held away from the side wall of the chamber by raised portions 13 around the edges of the chamber. This embodiment minimizes scratching of the back of the film 5 when the film is being loaded.

In FIG. 4C the roller 10 is held away from the surface of the film 5 by means of the film being held in slot 14. The distance between the roller surface and the film may be from 0.025 mm to 30 mm, preferably 0.1 mm to 5 mm. Even more preferably the distance will be between 0.1 mm to 1 mm.

Figure 5B:
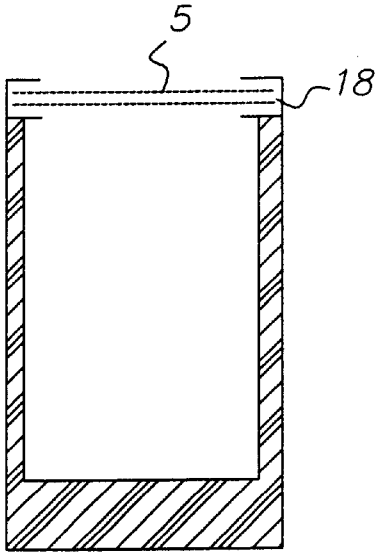
FIG. 5 shows a film holder for use with the present invention.
Figure 5A:
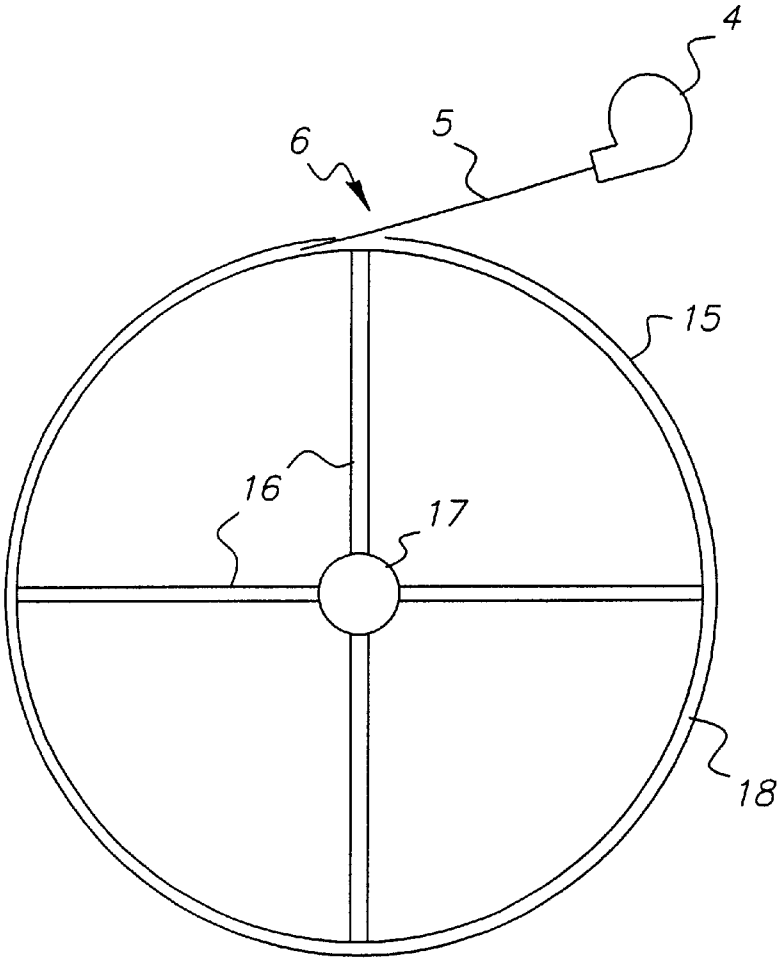

FIG. 5 shows an alternative method of holding the film 5. The holder 15 comprises a central spindle 17 from which radiates four members 16 terminating at the outer circumferential wall, formed of two concentric rings. The two rings form a slot 18. The film is held on the outside of the open holder 15 with the emulsion side facing out. The holder with the loaded film is then placed inside the processing chamber 1 which is rotated as before. The open holder 15 with the attached film rotates as the chamber rotates and the net effect is to provide agitation and wetting of the film surface. In this embodiment the film 5 is detached from the cassette.

Figure 6B:
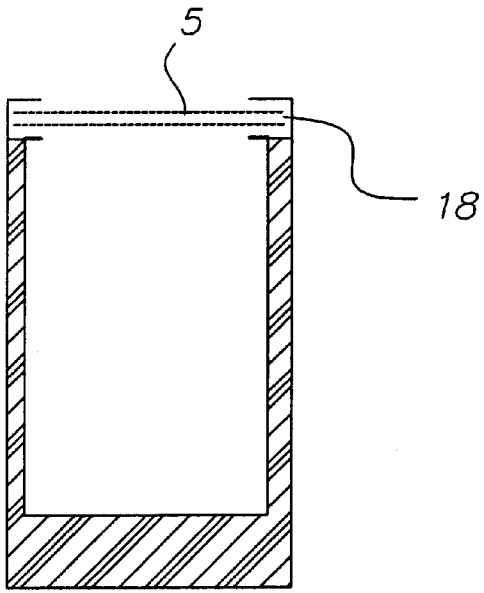
FIG. 6 shows another film holder for use with the present invention.
Figure 6A:
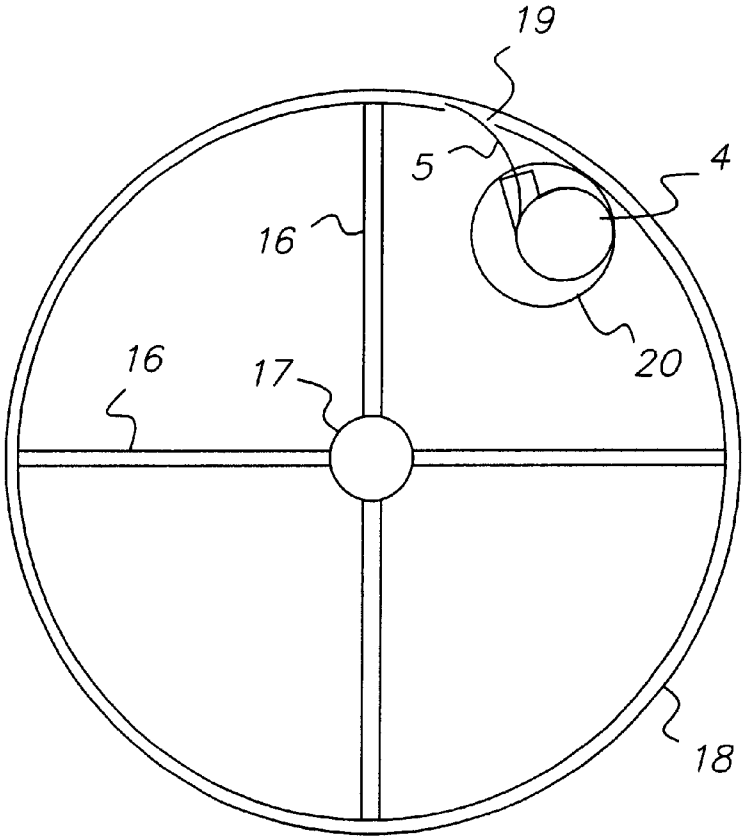

In FIG. 6 another version of the film holder is shown in which the film cassette 4 remains attached to the film 5 during processing. The holder is identical to that shown in FIG. 4 with the exception that the cassette 4 is located within a waterproof cassette holder 20 provided on the inside of the film holder and the film 5 is fed through a loading slot 19 found on the inner of the pair of concentric rings forming the wall.

The apparatus as described consists of a rotating processing chamber in which a complete process cycle such as develop, stop, bleach, fix and wash is carried out within the same processing chamber. The rotating chamber has a drive mechanism and it is possible to configure the apparatus so that there is more than one chamber which is able to use a common drive mechanism. If each chamber is arranged on a common spindle and each chamber has a separate clutch mechanism the rotation of an individual chamber can be stopped to load film independently of other chambers and then started again to carry out the process cycle. Each processing chamber can be provided with its own solution delivery system. This increases the productivity of the apparatus as a whole and will allow more than one film to be processed at the same time.

Figure 7:
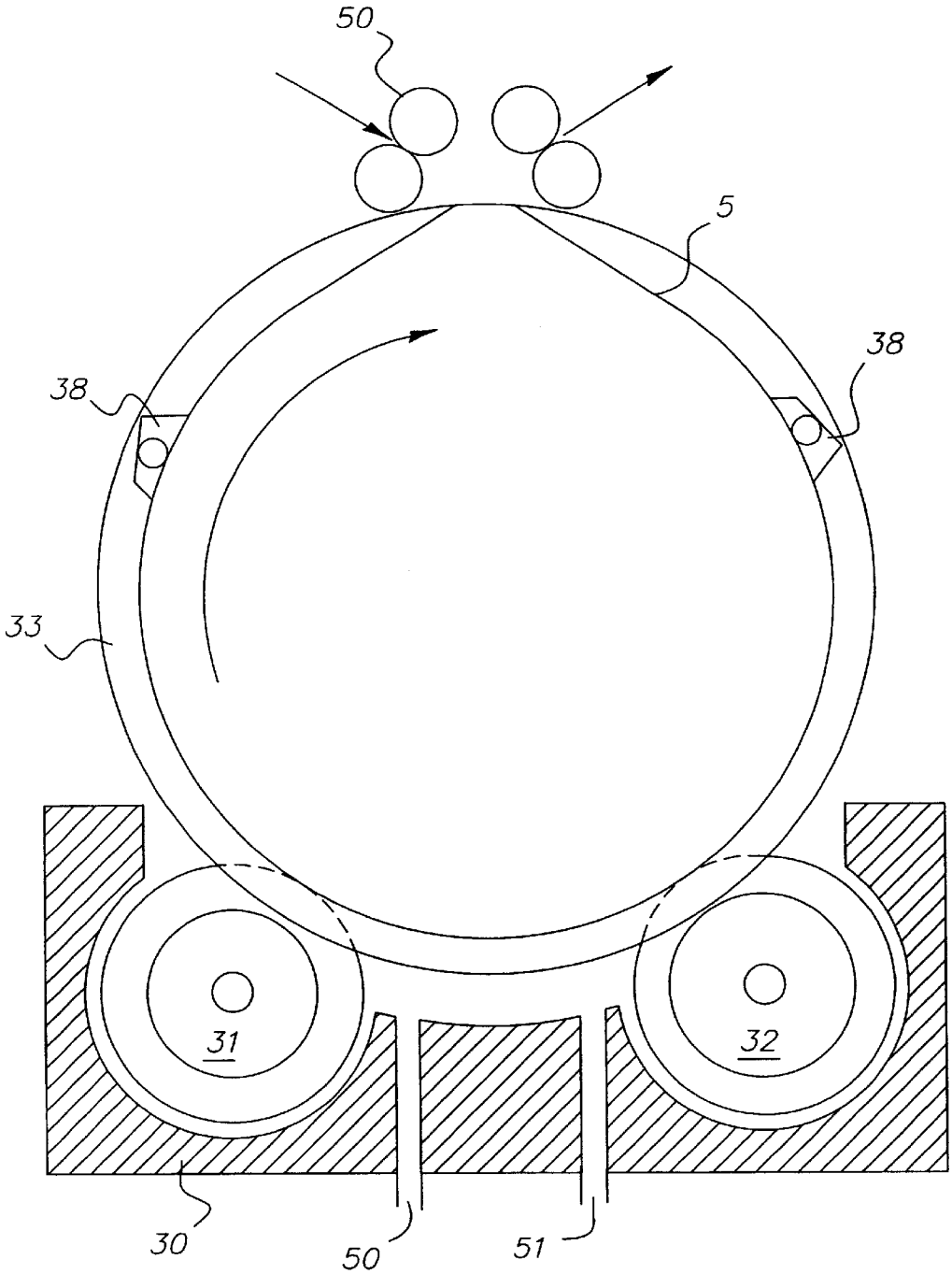
FIG. 7 shows a schematic cross-sectional view of a third embodiment of the invention.
Figure 8:
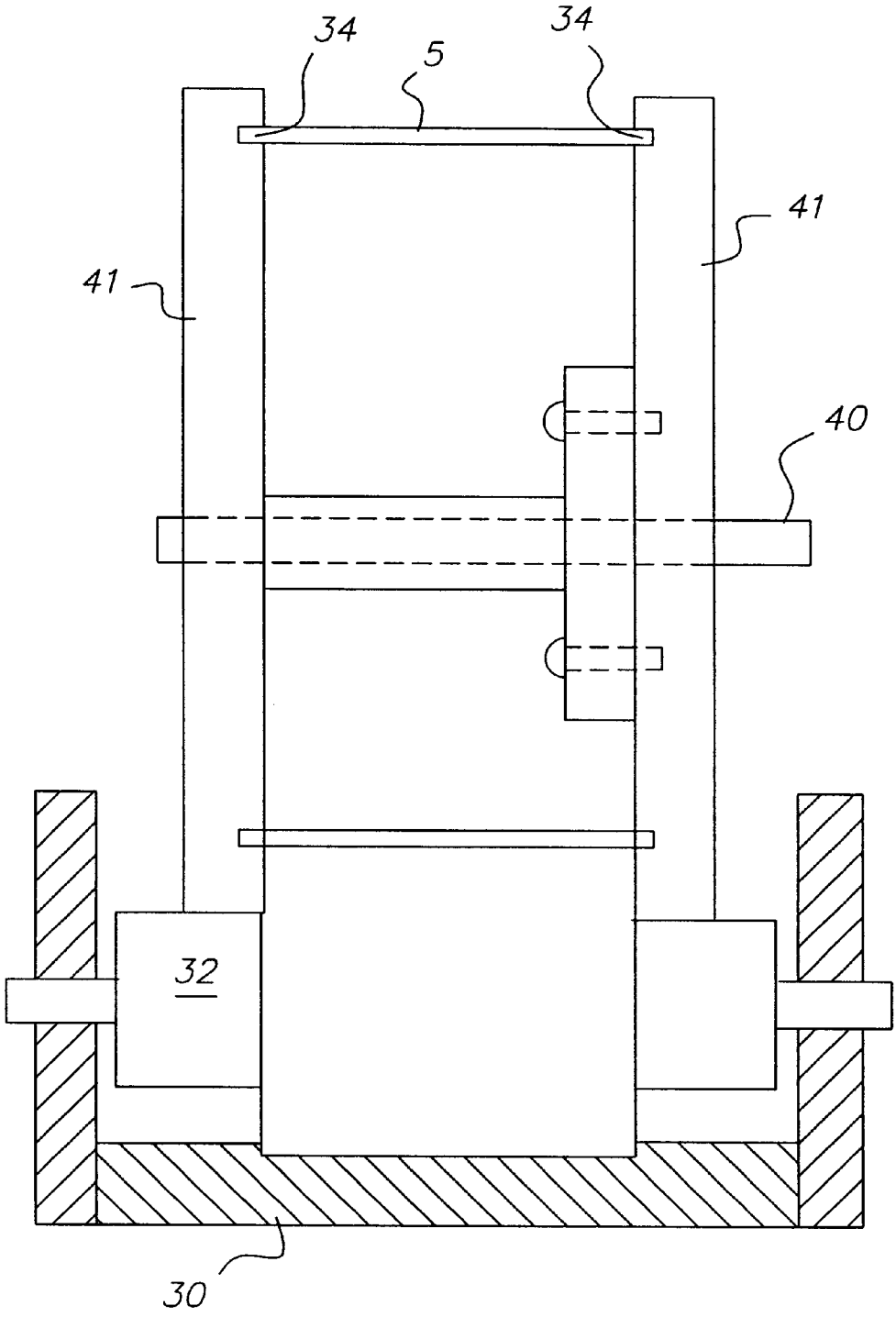
FIG. 8 shows a schematic side view of the embodiment shown in FIG. 7.

FIGS. 7 and 8 show a further processor. In this embodiment no processing chamber is required.

A container or tray 30 is provided for holding the processing solutions. The tray holds at least 20 ml of solution. An inlet 50 and an outlet 51 are provided for filling and emptying the tray. Two drive rollers 31, 32 are mounted within the tray 30 by means of bearings provided within the walls of the tray. A film holder or carrier 33 sits on the drive rollers and is rotated by rotation thereof. The carrier comprises two end plates 41 at either end of a central spindle 40. Each plate is provided with a groove 34 on the inner side thereof. The groove 34 is located towards the outer periphery of the end plate. The grooves hold the edges of film strip 5 loaded into the carrier. The rollers 31, 32 are arranged so that when a strip of film is held in the grooves 34 there is a minimum clearance of between 0.5 mm and 4 mm between the roller and the film. Two ball clutches 38 are provided on one of the end plates for loading and unloading the film strip.

Film 5 is fed into the stationary carrier 33 by means of drive rollers 42. The film is fed into the carrier with the emulsion side facing outwards. As the leading end of the film strip reaches ball clutch 38 one end plate 41 is rotated back and forth by about 10 degrees to enable the film to be fed around the groove. Such a feeding method is well known and is used extensively in Patterson daylight developing tanks. The film is thus wound into the carrier until the second ball clutch is reached, i.e. the film occupies the circular portion only of the feed path. Once the film is in place the drive rollers 31, 32 are activated. As the rollers rotate the carrier is driven round and the film passes through the solution in the tray. The rollers provide high agitation and mixing of the solution on the film surface.

Figure 9:
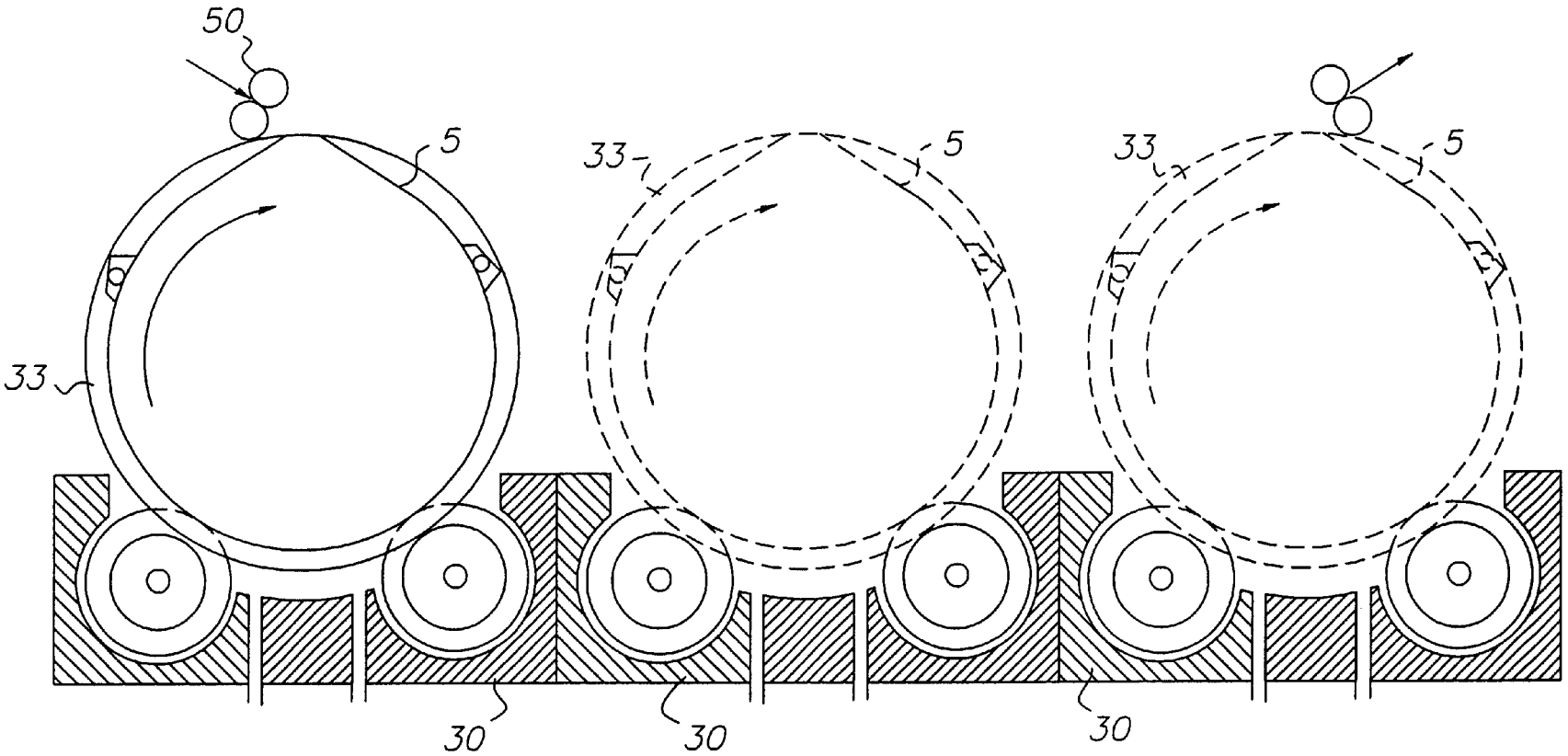
FIG. 9 shows a schematic view of the third embodiment used with a plurality of solution tanks.

The solution in the tray can be changed for each processing stage. Alternatively the carrier 33 can be moved to a further tray containing a different processing solution. This is shown in FIG. 9. It is possible to dry the film while it is within the carrier. The invention is described in more detail in the following examples.

EXAMPLE 1

Processing of a photographic material is usually done in a processing machine which has separate tanks for the developer, bleach, fix and wash stages although the bleach and fix stages can be combined for some materials as a single bleach-fix stage. In addition each tank of working strength solution is replenished to make up for the chemicals consumed by the photographic material by pumping in a replenisher solution. The replenisher solution is more concentrated than the tank solution and represents the amount of chemicals consumed by the film plus overflow and carry-out by the film. Thus if the normal working tank is disposed of and processing chemistry is applied directly to the surface of a photographic material the maximum amount needed is the replenisher volume and concentration. This is only true if adequate agitation and mixing of the small replenisher volume on the surface of the film is possible. This amount is however the amount of replenisher for an average film density or average customer density. The average customer density is equivalent to about 25% of Dmax or maximum density averaged over the whole film. If there is no mixing of the chemistry then enough chemistry must be applied to achieve 100% Dmax anywhere on the film, that is, four times the amount used for replenishment in a large tank process.

The invention described above avoids the problem mentioned above, unlike other surface application methods, and allows processing to be carried out by spreading a normal volume of replenisher over the film surface whilst mixing the applied solution on the surface continuously over the whole film area during the process. The C-41 process is an industry wide method for processing color negative film. The replenishment rate for the developer solution of the C-41 process is about 6 ml/linear foot or 19.8 ml/linear meter of 35 mm film. An apparatus as described in FIG. 1 was made to accommodate a one foot length of 35 mm film. The film was exposed to a sensitometric wedge and developed using 6 ml of C-41 replenisher solution (Kodak Flexicolor C-41 developer replenisher). This stage is described as the developer stage in the process cycle shown in Table 1.

TABLE 1

| Process Cycle | |
|---|---|
| Stage | Time |
| Developer | 3 minutes 15 seconds |
| Stop bath | 5 seconds |
| Bleach | 3 minutes 30 seconds |
| Fix | 4 minutes 30 seconds |
| Wash | 2 minutes |
| Process Temperature | 37.8° C. |

where the Bleach was Kodak Flexicolor Bleach III NR, Stop was 5% glacial acetic acid and the Fix was Kodak Flexicolor fixer.

A standard or check C-41 process was also carried out using a two liter processing tank and the same process cycle as shown in Table 1. In this case the developer stage used standard C-41 developer composition made from a Kodak Flexicolor developer-replenisher kit by dilution and the addition of Kodak Flexicolor developer starter, as per instructions on the bottles.

The low volume development was carried out in the rotary wave processor described in FIGS. 1A and 1B and using the volumes shown in Table 2. The process after the stop involved the removal of the strip from the rotary wave processor and subsequently was carried out in large tanks (2 liters) although it is also possible to carry out the entire process cycle including the develop, stop, bleach, fix and wash stages all in the small volume rotary wave processor as shown later in example 2.

TABLE 2

| Process Cycle | | |
|---|---|---|
| Stage | Volume added | Time |
| Develop | 6 ml | 3 minutes 15 seconds |
| Stop | 4 ml | 5 seconds |
| Bleach | in separate tank (2 liters) | 3 minutes 30 seconds |
| Fix | in separate tank (2 liters) | 4 minutes 30 seconds |
| Wash | in separate tank (2 liters) | 2 minutes |

Figure 10:
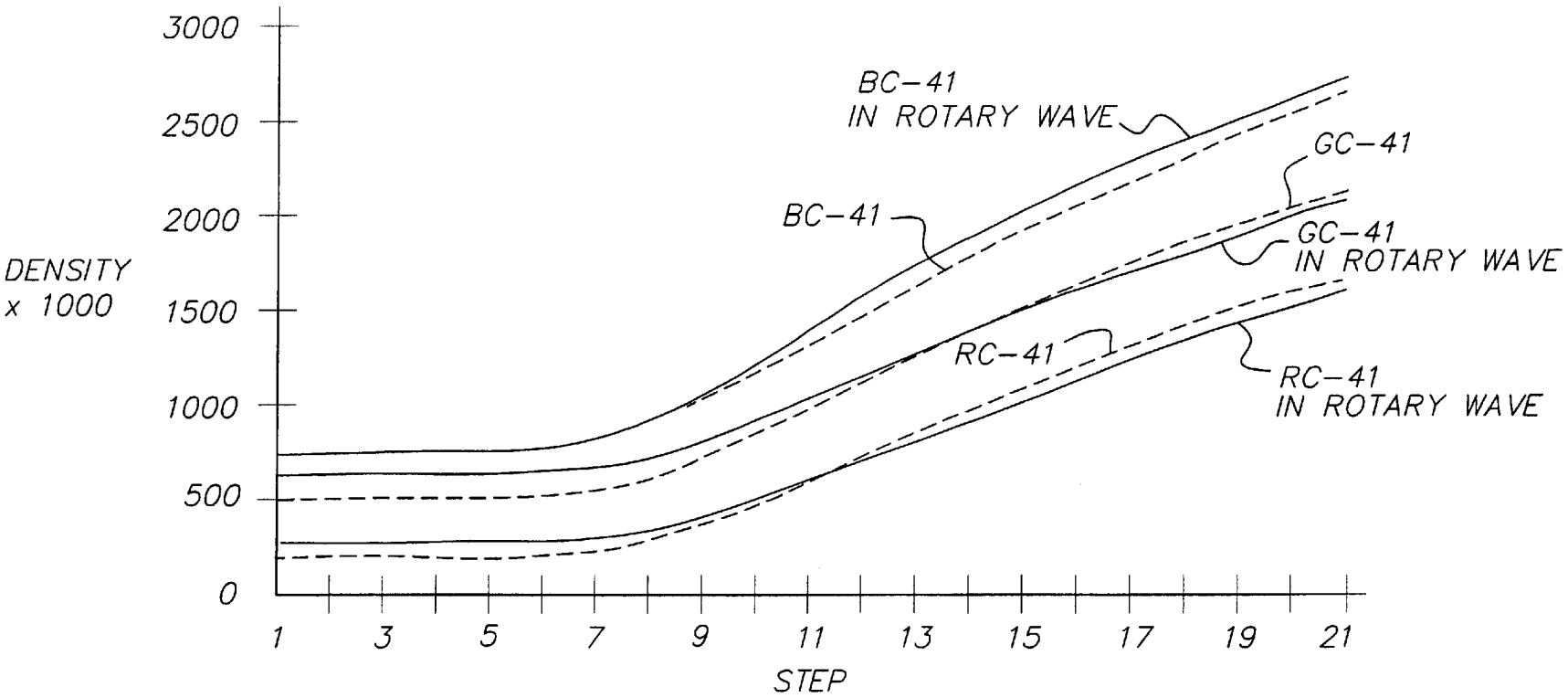
FIG. 10 is a graph comparing the method of the invention with a standard process.

In FIG. 10 a sensitometric comparison is made using a color negative film between the check C-41 process carried out in a two liter tank with nitrogen burst agitation and the low volume development carried out with 6 ml of solution in the apparatus described above.

It can be seen from FIG. 10 that there is a very close agreement between the standard process carried out in two liters and the low volume process carried out with 6 ml in the rotary wave processor. In addition it was apparent that the uniformity of the strip processed in the low volume apparatus was the same as that in the large tank. Thus the method of the invention has been demonstrated.

EXAMPLE 2

In this example the entire process was carried out in the rotary wave apparatus using a one foot length of 35 mm film. In this case 6 ml of the developer solution was added and after development and the stop was complete the used solution was removed by a vacuum suction tube. The next solution was then added for the prescribed time and again removed. This procedure was followed for each stage of the process and the process cycle and volumes used are shown in Table 3.

TABLE 3

| Process Cycle | | |
|---|---|---|
| Stage | Volume added | Time |
| Develop | 6 ml | 3 minutes 15 seconds |
| Stop | 4 ml | 5 seconds |
| Bleach | 2 ml | 3 minutes 30 seconds |
| Fix | 2 ml | 4 minutes 30 seconds |
| Wash | 4 × 2 ml | 2 minutes |

where the Stop was 5% glacial acetic acid, Bleach was Kodak Flexicolor Bleach III NR replenisher and the Fix was Kodak Flexicolor fixer replenisher concentrate.

The sensitometry obtained in this process is the same as obtained in example 1 and shown in FIG. 10.

EXAMPLE 3.

In this example a rapid process was carried out in the apparatus with a process cycle as shown in Table 4.

TABLE 4

| Rapid Process cycle | | |
|---|---|---|
| Stage film) | Time | Volume (ml/linear foot of 35 mm |
| Developer | 15 seconds | 3 ml/ft |
| Stop | 5 seconds | 4 ml/ft |
| Bleach | 45 seconds | 4 ml/ft |
| Fix | 30 seconds | 4 ml/ft |
| Wash water | 4 × 15 seconds | 4 × 5 ml/ft |

Where the developer composition is shown in Table 5.

TABLE 5

| Developer Composition | |
|---|---|
| $Na_3PO_4.12H_2O$ | 50 g/l |
| Diethylhydroxylamine | 5 g/l |
| CD4 | 10 g/l |
| KBr | 8 g/l |
| KOH | 20 g/l |
| Tween 80 | 40 drops |
| $Na_2SO_3$ | 2 g/l |

The stop bath composition is shown in Table 6.

TABLE 6

| Stop Bath Composition | |
|---|---|
| Acetic acid (glacial) | 50 g/l |
| $Na_2SO_3$ | 2 g/l |

The bleach composition is shown in Table 7.

TABLE 7

| Bleach Composition |
|---|
| Kodak Bleach III NR |

The fixer composition is shown in Table 8.

TABLE 8

| Fixer Composition |
|---|
| Kodak C-41 fixer replenisher diluted 1 + 3 with water |

Figure 11:
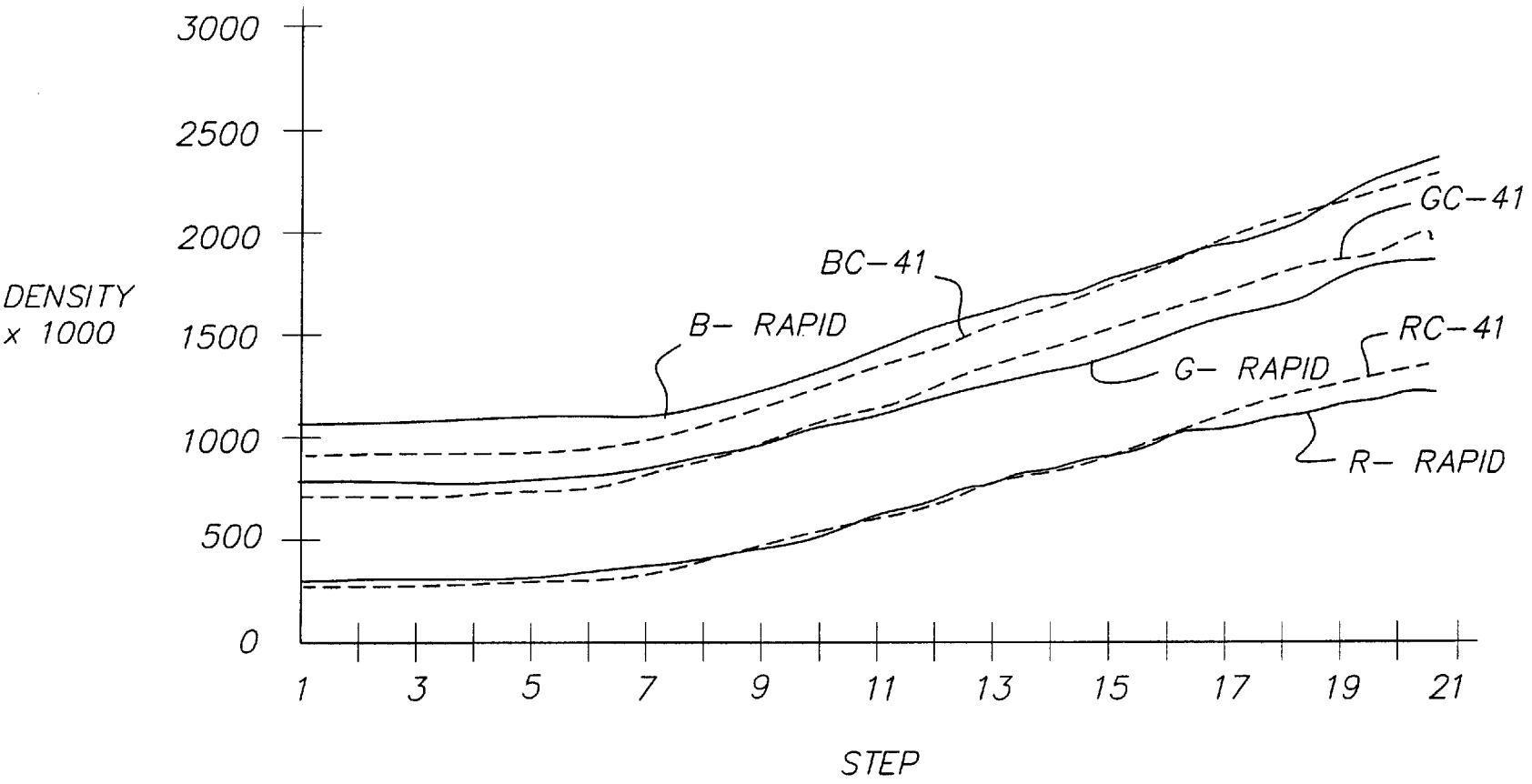
FIG. 11 is a graph comparing the method of the invention with a reference process.

The rapid process was carried out at 48° C. for each processing stage with a rotation speed of one revolution per second with a Perspex agitation roller. The entire process was run in a single vessel and solution was removed after the stop, after the bleach, after the fixer and in between and at the end of the four wash stages. An experimental color negative film was processed in the rapid process by the method of the invention and also in the standard C-41 color negative process in a sinkline consisting of 2 liter tanks and this represents the reference process. In FIG. 11 a comparison of the reference C-41 process and the rapid process is shown. It can be seen that the rapid process is very close in photographic performance to the reference process. In FIG. 10; R, G and B=red layer, green layer and blue layer densities respectively. Step=an exposure increment of 0.2 Log exposure units.

This example demonstrates the method of the invention in which very small volumes of processing solution can be used to process film without the need for large tanks.

This example demonstrates that rapid processing can be also be performed by the method of the invention. The C-41 reference process took 13 minutes 20 seconds and the rapid process took 2 minutes 35 seconds. This example demonstrates that an entire process can be performed in a single processing space according to the method of the invention.

EXAMPLE 4

This is an example of the invention.

The apparatus of the invention can be used in a method of processing in which the entire process cycle is carried out in the rotating chamber. The process cycle could be; developer, stop, bleach, fix and wash. It is important in such a method that contamination of the rotating chamber by chemicals from a preceding process does not significantly affect processing of the next film. Contamination by fixer components, such as thiosulfate is well known and can affect development of the image adversely in at least two ways. If the developer is contaminated by fixer, premature fixing can occur which lowers the developed density in upper-scale exposures. Another effect of fixer contamination of the developer is to cause unwanted development for low exposures and minimum density areas. After a process has been completed the rotating chamber is dried before the next film is loaded. It has been found unexpectedly that contamination by fixer components in the rotating chamber is hardly transferred to the developer solution if the rotating chamber is dried down in between processing one film and the next. Two types of experiment were carried out; one in which the chamber was dried after fixing and washing before the next film was processed and one in which the drum was not dried before the next film was processed. After the fix stage six separate film samples were given six different treatments; no wash, 1 wash, 2 washes , 3 washes or 4 washes and a check wash was carried out where the film was washed in a tank outside the rotating chamber. This procedure was repeated for one set in which the chamber was not dried down after the film was removed and one set in which the chamber was dried down after the film was removed. It can be seen from Tables 9 and 10 that if there is no wash at all, which means that all the fixer was left in the rotating chamber and the next film was processed, there is essentially no development and the Dmax and Dmin densities are the same. After one wash the Dmax is almost completely restored compared with the check in the case where the chamber was dried down before the next film was processed but not in the case where the chamber was not dried down. In addition the Dmin was elevated above the check in both cases. After two washes the Dmax and Dmin are completely restored where the chamber was dried down as shown in Table 10. It takes three or four washes to restore Dmax and Dmin if the chamber is not dried down as shown in Table 9. Thus it has been demonstrated that the method of the invention in which the rotating chamber is dried down in between processing films is less sensitive to fixer contamination than a conventional processor where it is not possible to dry the processing chamber in between processing films.

TABLE 9

The effect of fixer contamination chamber not dried

| | Not dried down | | | | | |
|---|---|---|---|---|---|---|
| | Dmax | | | Dmin | | |
| washes | R | G | B | R | G | B |
| 0 | 0.20 | 0.65 | 1.0 | 0.20 | 0.65 | 1.02 |
| 1 | 0.55 | 1.14 | 1.23 | 0.25 | 0.77 | 1.03 |
| 2 | 0.85 | 1.31 | 2.10 | 0.26 | 0.67 | 1.01 |
| 3 | 0.94 | 1.38 | 2.35 | 0.20 | 0.66 | 1.03 |
| 4 | 1.09 | 1.37 | 2.48 | 0.20 | 0.67 | 1.02 |
| check | 1.09 | 1.39 | 2.45 | 0.20 | 0.65 | 1.02 |

TABLE 10

The effect of fixer contamination chamber dried down

| | Dried down | | | | | |
|---|---|---|---|---|---|---|
| | Dmax | | | Dmin | | |
| washes | R | G | B | R | G | B |
| 0 | 0.20 | 0.65 | 1.05 | 0.20 | 0.65 | 1.05 |
| 1 | 0.99 | 1.42 | 2.24 | 0.25 | 0.75 | 1.05 |
| 2 | 1.07 | 1.38 | 2.45 | 0.20 | 0.65 | 1.03 |
| 3 | 1.09 | 1.40 | 2.44 | 0.20 | 0.65 | 1.03 |
| 4 | 1.07 | 1.38 | 2.46 | 0.20 | 0.65 | 1.02 |
| check | 1.09 | 1.39 | 2.45 | 0.20 | 0.65 | 1.02 |

The invention provides a more efficient use of chemistry than single application methods known in the art.

The invention is equally applicable to color film, color paper, reversal film, reversal paper, black and white film or paper. It works equally well with 35 mm film and APS film. It is equally applicable for conventional or redox amplification processing or intensification processing.

The invention is designed primarily to be used in single use mode but it can also be used in batch, or replenished mode. In batch mode, solutions can be withdrawn from a reservoir, used to process within the rotating chamber, removed from the chamber and then returned to the reservoir. In replenished mode solution can be withdrawn from a reservoir, used to process within the rotating chamber, removed from the chamber and then returned to the reservoir which is then replenished. Single use mode is the method normally employed in the invention.

The examples described above show the use of the invention in "single use" mode in which the volume of solution used for each film is discarded. In this mode of operation the volume used per film can be the same as the replenishment rate for a large tank process and so the chemicals consumed are the same except that in the method of the invention there are no large tanks which must ultimately be discarded in order to refresh or clean the tanks. Thus even at the same replenishment volume as a conventional method, the method of the invention is more efficient in the use of chemicals. Furthermore because non-standard or less stable solutions can be used in the method of the invention smaller volumes can be used than those used to replenish a conventional large tank. The developer volume used in example 3 and shown in Table 4 is half that of the conventional process. Thus the method of the invention is further beneficial in terms of chemical efficiency. Even greater chemical efficiency than that just described can be achieved because processing solutions can be run close to exhaustion in the method of the invention. This is not possible in conventional methods. Thus the concentration of color developing agent in the waste solution can be much lower in the method of the invention than in conventional methods. This is beneficial in terms of cost and environmental load.

Although the above described use of very small volumes of processing solution is very beneficial for chemical efficiency and reduced environmental load it is also possible to use the apparatus described in ways other than the single use mode. The apparatus can be used in replenished mode where processing solution overflows either as waste as in a large tank processor or is collected and returned to a reservoir as in quasi-flooded replenishment (U.S. Pat. No. 5,298,932). Thus although the method and apparatus are designed for small volume use, this does not preclude the use of large volumes in the apparatus. The volume and chemical efficiency would then only be the same as a conventional processor. It is possible that some method would require the use of small volumes in one or more of the stages of a process, in combination with the use of large volumes in one or more of the other stages of the process. Thus the method and apparatus are versatile.

The normal mode of operation of the invention is to provide processing solutions that are added to the rotating chamber and then discarded after the process is complete. It is well known that solid tablets of processing chemicals can be added to replenish processing solutions used in conventional deep tank processors. It has been found that some of the components which are used to make tablets, such as the binding material, can have a detrimental effect on the process because they build-up in the processing solution. Since the method of the invention uses the same processing chamber for the whole process there is no possibility of build-up of binder. Thus solid tablets can be dissolved in water or buffer solution in a separate chamber just before processing begins and the solution formed is then transferred from the separate chamber and added to the rotating chamber. The solution is then discarded after the processing stage is complete thus avoiding any component build-up. This can be carried out for any stage of the process.

It is also possible to add solid tablets directly to a processing solution in the rotating chamber even though the volume of solution in the chamber is small and even in the presence of film within the chamber. This is because of the very high agitation provided by the roller within the rotating chamber. The tablets can be small and round so as not to damage the film surface and it is desirable that they dissolve rapidly.

The invention has been described in detail with reference to certain preferred embodiments thereof. It will be understood by those skilled in the art that variations and modifications can be effected within the spirit and scope of the invention. PARTS LIST

1. cylinder
2. drive shaft
3. arm
4. film cassette
5. film
6. slot
7. flange
8. syringe
9. reservoir
10. roller
11. air knife
14. slot
15. holder
16. member
17. spindle
18. slot
19. loading slot
20. cassette holder
21. arm
30. container
31. drive roller
32. drive roller
33. carrier
34. groove
38. ball clutch
40. spindle
41. end plate
42. drive roller
50. inlet
51. outlet
52. spreader

What is claimed is:

1. A method of processing a photographic material, comprising the steps of loading the material into a chamber adapted to hold the material therein, automatically introducing a metered amount of solution into the chamber, rotating the chamber and continuously sweeping the surface of the material as the chamber rotates to thereby form a wave in the solution in the direction of travel of the material through which the material passes, the whole volume of solution for a given stage being spread over the whole material area in a repetitive manner to enable uniform processing.

2. A method as claimed in claim 1 including the step of heating the chamber.

3. A method as claimed in claim 2 wherein the chamber is heated electrically.

4. A method as claimed in claim 2 wherein the chamber is heated by hot air.

5. A method as claimed in claim 2 wherein the chamber is heated by passing the lower part of the chamber through a heated water bath.

6. A method as claimed in claim 1 wherein the solution is removed from the chamber by suction.

7. A method as claimed in claim 1 wherein the volume of processing solution is 0.1 to 20 ml/linear foot (0.33 to 66 ml/linear meter) of 35 mm film.

8. A method as claimed in claim 7 wherein the volume of processing solution is 0.5 to 10 ml/linear foot (1.65 ml to 33 ml/linear meter) of 35 mm film.

9. A method as claimed in claim 8 wherein the volume of processing solution is 2 ml to 8 ml/linear foot(6.6 ml to 26.4 ml/linear meter) of 35 mm film.

10. A method as claimed in claim 1 wherein the chamber and processing solution can be operated at temperatures of up to 80° C.

11. A method as claimed in claim 1 wherein the processing solutions are "unstable" or only stable for the duration of the process time.

12. A method as claimed in claim 11 wherein the "unstable" processing solutions are made by mixing two or more stable solutions before or during addition to the processing chamber.

13. A method as claimed in claim 1 wherein the processing solutions are supplied as stable concentrates protected from exposure to air thus providing processing chemicals which are fresh, which chemicals are immediately disposed of after each process, thus eliminating the need for process control strips.

14. A method as claimed in claim 1 wherein the time of a development stage is between 10 seconds and 3 minutes 15 seconds.

15. A method as claimed in claim 1 wherein the time of a bleach stage is between 10 seconds and 3 minutes 30 seconds.

16. A method as claimed in claim 1 wherein the time of a fix stage is between 10 seconds and 3 minutes 30 seconds.

17. A method as claimed in claim 1 wherein a given process stage is performed by the sequential addition of two or more separate solutions.

18. A method as claimed in claim 1 wherein a given process stage is performed by the addition of a single solution.

19. A method as claimed in claim 1 wherein the entire process can be carried out in a single chamber.

20. A method as claimed in claim 19 wherein every stage of the entire process cycle is performed in the single chamber by sequentially adding and removing processing solutions for a given stage followed by adding and removing the processing solutions for the next stage and so on to complete the process cycle.

21. A method as claimed in claim 1 in which a truncated or partial process is carried out wherein one or more of the stages of a process cycle is omitted.

22. A method as claimed in claim 1 wherein the material is dried in the same chamber.

23. A method as claimed in claim 1 wherein the material is scanned while still in the chamber and the information obtained electronically stored.

24. A method as claimed in claim 1 wherein one or more stages of the complete process cycle can be performed outside the rotating chamber with at least one stage of the process cycle completed within the rotating chamber.

25. A method as claimed in claim 1 wherein the solution is preheated to the same or different temperature to the chamber before addition to the chamber.

26. A method as claimed in claim 1 wherein the solution is unheated and the chamber is heated before addition of the solution to the chamber.

27. A method as claimed in claim 1 wherein the solution is heated and the chamber unheated before addition of the solution to the chamber.

28. A method as claimed in claim 1 wherein solution is added or removed while the chamber is rotating.

29. A method as claimed in claim 28 wherein solution is added slowly over several rotations of the chamber.

30. A method as claimed in claim 28 wherein solution is added by "dumping" or pouring in less than one rotation of the chamber.

31. A method as claimed in claim 1 wherein solution is added or removed while the chamber is stationary.

32. A method as claimed in claim 1 wherein one or more of the processing stages carried out in the rotating chamber are run in batch mode, in which the solution is removed from the reservoir, introduced into the chamber, used to process in the chamber and returned to the reservoir, the process being repeated until the solution in the reservoir no longer gives satisfactory sensitometry.

33. A method as claimed in claim 1 wherein one or more of the processing stages carried out in the processing chamber are run in replenished mode, in which the solution is removed from a reservoir, introduced into the chamber, used to process in the chamber and returned to the reservoir, the reservoir then being replenished in order to maintain constant activity of the processing solution.

34. A method as claimed in claim 1 wherein the process can be customized to suit any particular film.

35. A method as claimed in claim 1 wherein any photographic processing cycle can be operated in the same processor by selecting appropriate software options that control the timing of solution addition and removal.

36. A method as claimed in claim 1 wherein the solution of any process may be run to exhaustion.

37. A method as claimed in claim 1 wherein any photographic processing cycle can be operated in the same processor by changing the solution supply containers.

38. A method as claimed in claim 1 wherein the solution is disposed of after use.

39. A method as claimed in claim 1 wherein the solution is reused.

40. A method as claimed in claim 1 wherein the processing solution is made from solid tablets which are predissolved in a separate chamber and which processing solution is then added to the rotating chamber.

41. A method as claimed in claim 1 wherein solid tablets can be added to the rotating chamber to make up a processing solution or to modify a processing solution within the chamber.

42. A method as claimed in claim 1 wherein the rotating chamber is dried down in between processing one film and the next.

43. A method as claimed in claim 1 wherein photographic performance is maintained constant between 100% utilization and 0.1% utilization.

44. A method as claimed in claim 1 wherein the processor self cleans during the operation of a process cycle.

45. A method as claimed in claim 1 used for Redox amplification processing.

46. An apparatus for processing a photographic material, comprising a chamber adapted to hold the material therein, means for automatically introducing a metered amount of solution into the chamber, means for removing the solution from the chamber, means for rotating the chamber and means for sweeping the surface of the material at each rotation of the chamber, thereby to form a wave in the solution in the direction of travel of the material through which the length of material may pass.

47. Apparatus as claimed in claim 46 wherein the means for sweeping the surface of the material comprises a roller.

48. Apparatus as claimed in claim 46 wherein the means for sweeping the surface of the material comprises a plurality of balls having a diameter in the region of 3 to 5 mm.

49. Apparatus as claimed in claim 48 wherein the balls are made of glass.

50. Apparatus as claimed in claim 48 wherein the balls are made of a plastics material.

51. Apparatus as claimed in claim 46 wherein the means for sweeping the surface of the material comprises an air knife.

52. Apparatus as claimed in claim 46 wherein the means for sweeping the surface of the material comprises an electrostatically charged rod.

53. Apparatus as claimed in claim 46 wherein the means for sweeping the surface of the material comprises a flexible member, one end being supported by supporting means to allow the other end to drape onto the surface of the material.

54. Apparatus as claimed in claim 53 wherein the flexible member comprises a sheet of plastics material.

55. Apparatus as claimed in claim 53 wherein the flexible member comprises a plastic mesh.

56. Apparatus as claimed in claim 53 wherein the flexible member comprises a sheet of silk-screen material.

57. Apparatus as claimed in claim 46 further comprising heating means for heating the chamber.

58. Apparatus as claimed in claim 46 wherein the solution is introduced into the chamber by means of a syringe.

59. Apparatus as claimed in claim 46 wherein the solution is introduced into the chamber by means of a metering pump.

60. Apparatus as claimed in claim 46 wherein the solution is removed from the chamber by suction means.

61. Apparatus as claimed in claim 46 wherein the chamber is made of a transparent material.

62. A method of scanning a photographic material in which the material is still within the processing chamber of a processing apparatus, the apparatus being as claimed in claim 61.

63. Apparatus as claimed in claim 46 wherein an infrared sensor is mounted internally of the chamber to monitor the state of the process.

64. Apparatus as claimed in claim 46 wherein the inner wall of the chamber is provided with slots for holding the material.

65. Apparatus as claimed in claim 46 wherein additional tanks and means of transport are provided to carry out one or more stages of a complete process cycle outside the rotating chamber with at least one stage of the process cycle being completed within the rotating chamber.

66. Apparatus as claimed in claim 46 wherein a cover is provided around the inner circumference of the chamber at a distance such that when a film strip is loaded in the chamber the cover is at least 0.5 mm above the film surface all the way around the circumference thereof.

67. Apparatus as claimed in claim 66 wherein the cover is fixed with respect to the chamber and rotates as the chamber rotates.

68. Apparatus as claimed in claim 66 wherein the cover is slidably located on rails and remains stationary as the chamber rotates.

69. Apparatus as claimed in claim 66 wherein the cover has a break or gap in the circumference thereof through which the processing solution is added to the film surface.

70. Apparatus as claimed in claim 69 wherein the roller sits in the break or gap in the circumference of the cover, the roller remaining at the lowest point of the chamber and rotating as the chamber rotates.

71. Apparatus as claimed in claim 66 wherein the cover is made of a solid material impervious to the processing solution.

72. Apparatus as claimed in claim 66 wherein the cover is made of a porous material which allows free passage of the processing solution through the cover.

73. Apparatus as claimed in claim 66 comprising a plurality of processing chambers.

74. Apparatus as claimed in claim 46 wherein more than one rotating processing chamber is mounted on a common drive mechanism.

75. Apparatus as claimed in claim 73 wherein each individual rotating processing chamber is provided with a clutch mechanism to allow independent rotation of any rotating processing chamber.

76. Apparatus as claimed in claim 73 wherein each individual rotating processing chamber is provided with a solution delivery and solution removal system.

77. Apparatus as claimed in claim 73 wherein the more than one rotating processing chambers are of the same or of different circumference and width.

78. Apparatus as claimed in claim 73 wherein each processing chamber is provided with a film loading mechanism.

79. Apparatus as claimed in claim 46 wherein the chamber is self-cleaning during operation of a process cycle.

80. Apparatus as claimed in claim 46 wherein the total footprint is substantially less than 1 square meter.

81. A method of processing photographic material comprising the steps of loading the material onto a carrier with the photosensitive side facing outwards, the carrier resting on drivable rollers such that the clearance between the surface of the material and the rollers is minimal, the rollers being located within a container of processing solution, driving the rollers, the rotation of the rollers causing the carrier to rotate and thus the material to pass through the processing solution, thereby providing agitation and mixing of the solution on the surface of the material to enable uniform processing.

82. A method as claimed in claim 81 wherein the solution within the container is changed for each processing stage.

83. A method as claimed in claim 81 wherein the carrier is moved between trays holding differing processing solutions.

84. A method as claimed in claim 81 wherein the material is dried within the carrier.

85. Apparatus for processing photographic material, comprising a container for holding processing solution, a number of drivable rollers located within the container, and a carrier for carrying the photographic material with the photosensitive side facing outwards, the carrier resting on the rollers, the drivable rollers and the carrier being spaced such that when the carrier is loaded with the material the gap between the surface of the material and the roller is minimal.

86. Apparatus as claimed in claim 85 wherein the gap between the drivable rollers and the material is between 0.5 mm and 4 mm.

87. Apparatus as claimed in claim 85 wherein the carrier is formed of two end plates joined by a central spindle member.

88. Apparatus as claimed in claim 85 wherein the material is held in the carrier by means of grooves provided in the plates.

* * * * *